United States Patent [19]

Escott

[11] 4,002,422

[45] Jan. 11, 1977

[54] PACKED BED HEAT EXCHANGER

[75] Inventor: Robert Milton Escott, Charlotte, N.C.

[73] Assignee: Midrex Corporation, Charlotte, N.C.

[22] Filed: Sept. 22, 1975

[21] Appl. No.: 615,460

[52] U.S. Cl. ..... 432/99; 432/79

[51] Int. Cl.[2] ..... F27D 1/08; F27D 1/12; F27B 9/10

[58] Field of Search ..... 432/78, 79, 95, 96, 432/99

[56] References Cited

UNITED STATES PATENTS

| | | | |
|---|---|---|---|
| 2,345,067 | 3/1944 | Osann | 432/99 X |
| 2,502,501 | 4/1950 | Armitage | 432/99 X |
| 3,427,367 | 2/1969 | Kiehl | 432/79 X |
| 3,544,090 | 12/1970 | Peeters | 432/79 |

*Primary Examiner*—John J. Camby
*Attorney, Agent, or Firm*—Ralph H. Dougherty

[57] ABSTRACT

Apparatus for treating particulate material with hot gases wherein preheated gases are introduced to the particulate material to heat and treat such material and a second cooler gas is introduced to the heated material to impart some cooling to the material and to heat the second gas to treatment temperature followed by movement of the heated second gas through the bed of material in which it acts in the same manner as the hot treating gas.

7 Claims, 1 Drawing Figure

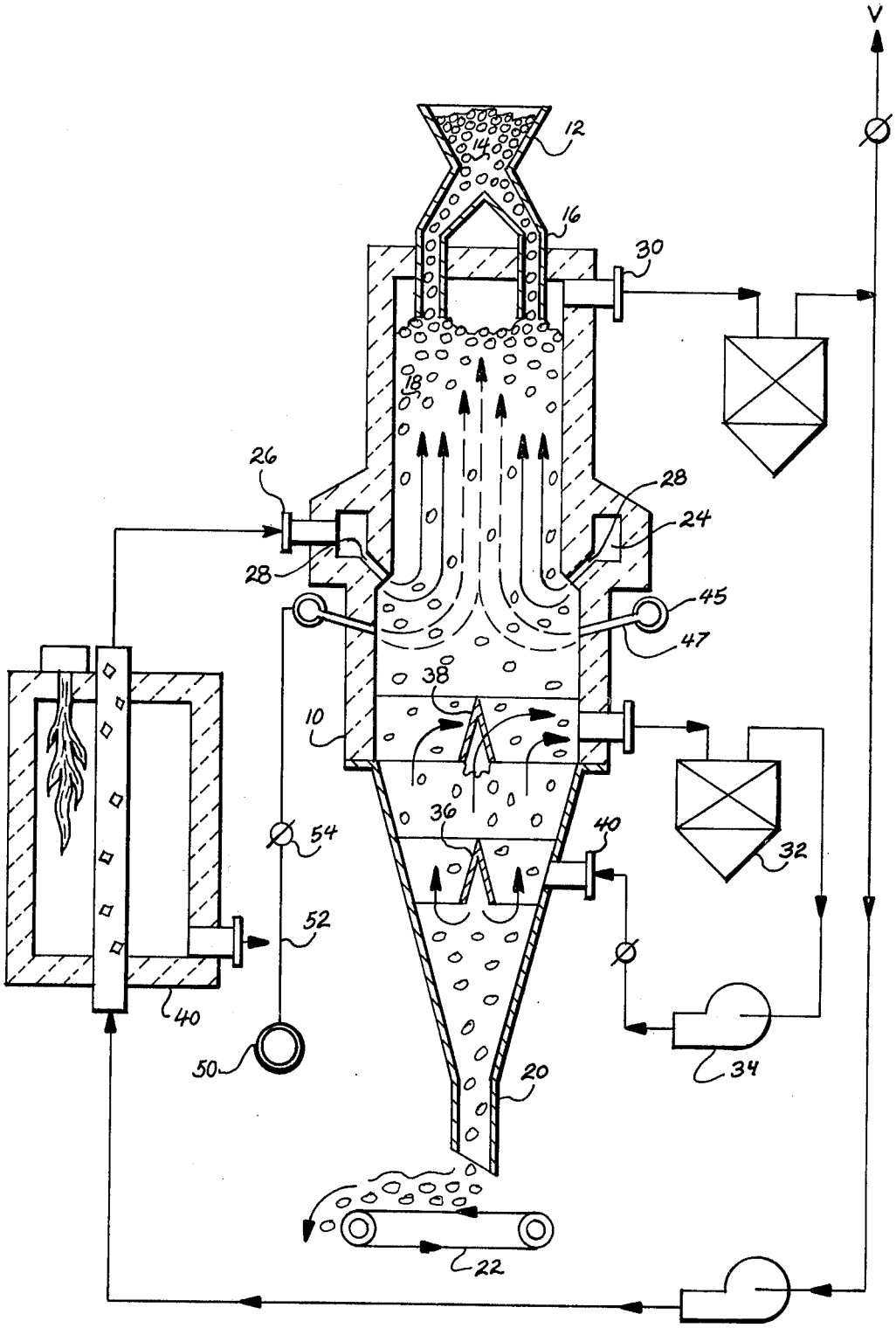
V
12
14
16
30
18
26
28
24
28
45
47
38
10
36
40
32
54
52
40
50
34
20
22

PACKED BED HEAT EXCHANGER

BACKGROUND OF THE INVENTION

This invention relates to the continuous heat processing of free flowing bulk materials in a vertical shaft furnace. Feed materials usually having a greatest dimension smaller than one inch are introduced to the top of a furnace to form a bed of such materials, or burden. The burden moves downwardly under the influence of gravity and the treated particulate product is removed from the bottom of the furnace thereby setting up a gravitational flow of material. The rate of material throughput is determined by the rate of discharge of the product.

Heated process gases are introduced around the periphery of the shaft furnace and flow upwardly through a treating zone in counterflow heat exchange with the descending burden. Thus the product leaving the treating zone has a temperature essentially equal to that of the incoming heated process gas.

In the continuous direct reduction of iron oxide to iron in a vertical shaft furnace it is necessary to cool the product prior to its discharge. It is thus desirable to improve the economics and thermal efficiency of such a process by recuperating a portion of the heat content of the product.

I have developed an improved shaft furnace apparatus having means for injecting a cold gas stream into a hot packed bed in a zone beneath the heat processing zone. The cold gas stream takes on heat from the heated burden, the burden becoming cooled thereby. The stream of cold gas is introduced around the periphery of the furnace but below the hot process gas inlets. The cold gas stream follows a path through the burden roughly parallel to that of the hot process gas stream with virtually no intermixing. As the gas reaches the center of the burden it moves upwardly, and eventually exits the burden at the stock line from the central region of the top of the furnace.

As the cold gases enter the furnace, they contact hot particles, which have been previously heated by the main hot process gases. These particles have sufficient area and heat content to raise the temperature of the cold gases to essentially that of the burden before these gases enter the processing zone.

OBJECTS OF THE INVENTION

It is the principal object of the subject invention to provide an apparatus for utilizing the heat of a packed bed to raise the temperature of cold process gas to processing temperature.

It is another object of this invention to provide means for reducing the cooling requirements of a product from a continuous heat treating process.

BRIEF DESCRIPTION OF THE DRAWING

These and other objects will be more readily apparent from the following detailed specification and the appended drawing in which:

The single FIGURE is a sectional elevation of a vertical shaft furnace for the direct reduction of iron employing the apparatus of the instant invention.

DETAILED DESCRIPTION

Although the invention is applicable to shaft furnaces in general, it will be described in conjunction with a vertical shaft furnace for the direct reduction of iron.

Referring now to the FIGURE, a vertical shaft furnace 10 has a feed hopper 12 mounted at the top thereof into which free flowing bulk materials 14 such as iron oxide pellets or other material are charged. The pellets descend by gravity through feed pipe 16 to form a bed 18 of particulate material to be treated, or burden, in the shaft furnace. The upper portion of the shaft furnace 10 comprises a heat treating zone or in the case of a direct reduction furnace a reducing zone, while the lower portion of the furnace comprises a cooling zone. Beneath the heat treating zone and above the cooling zone, is a region in which no treatment is performed. This region may be termed a buffer zone or in this application a cross-flow heat exchange zone. A product discharge pipe 20 is located at the bottom of shaft furnace 10, through which reduced material is removed from the furnace to discharge conveyor 22. Removal of the reduced material from the discharge pipe 20 establishes a gravitational flow of the burden through the shaft furnace. A bustle and tuyere system 24 surrounds the central portion of the furnace 10. Hot reducing gas is introduced to the reducing zone of the furnace through gas ports 28 from which the gas flows upwardly in counterflow relationship to the movement of the burden 18. The spent top-gas exits the furnace through gas takeoff pipe 30.

The cooling zone of the furnace may include any conventional cooling system. The cooling gas system shown is a closed loop recirculating system including a cooler 32, a recirculating gas blower 34, a gas distributing member 36 located within the furnace, and a cooling gas collection and removal member 38 positioned above distributing member 36, and the required piping connections.

Hot process gas, which may be heated in a reformer furnace 40 enters the bustle and tuyere system 24 through gas inlet 26.

A second bustle and tuyere system surround shaft furnace 10 beneath bustle and tuyere system 24. Bustle 45 has connected to it a large number of tuyeres 47, each of which extends through the furnace lining around its periphery. Tuyeres 47 are usually inclined downwardly in the same manner as gas inlet ports 28. Bustle 45 communicates with a source of gas 50 through pipe 52 having a control valve 54 therein.

In operation, hot reducing gases are injected into the furnace through gas ports 28 around the periphery of the furnace from whence they flow inwardly and upwardly in counterflow heat exchange with the descending burden. Cold process gases are introduced to the buffer zone of the furnace from source 50 through bustle 45 and tuyeres 47 around the periphery of the furnace. These gases contact the hot particles of the burden and are heated thereby, rendering such gases essentially equivalent to that of the hot process gas stream after the cold gases have been heated to the process temperature by cross-flow heat exchange with the burden. Upon reaching the center of the furnace, these gases turn upwardly and act upon the burden in the same manner as the hot process gas. Thus these cold gases are preheated and formed into reducing gases in the furnace, which not only increases the total amount of reducing gas available, but also utilizes the waste heat of the burden as well as reduces the amount of heat that is required to be removed from the burden in the cooling zone.

ALTERNATIVE EMBODIMENTS

Cold gas inlet 47 could be a peripheral slot or a series of rectangular slots. Inlets could be horizontal or inclined downwardly to prevent particulate material from entering and clogging the inlet.

The furnace may have any desired cross-section, i.e., round, rectangular, oval, etc.

Pipes need not be round, but may have any desired tubular cross-section.

SUMMARY OF THE ACHIEVEMENT OF THE OBJECTS OF THE INVENTION

It is clear from the above that I have invented an apparatus by which cold process gas is heated to process temperature by cross-flow heat exchange with a packed bed of hot particulate material. Since the cold gas absorbs heat from the hot burden, the product cooling requirements have been reduced.

Although only a few embodiments of this invention have been shown and described, it will be understood that changes and modifications can be made therein. Therefore this invention is limited only by the scope of the following claims.

What is claimed is:

1. Apparatus for treating particulate material with hot gases comprising:

a. a substantially vertical shaft furnace;

b. means for introducing particulate material at one end of said shaft furnace to form a packed bed therein;

c. means for removing treated particulate material at the other end of said furnace, thereby setting up a gravitational flow of material therein;

d. means intermediate said material introduction means and said material removal means for introducing hot process gas to said bed of material;

e. means intermediate said hot gas introduction means and said material removal means for introducing cold process gas to said packed bed, and for moving said cold process gas inwardly through said packed bed, whereby a portion of the heat of said descending bed is transferred to said cold process gas, heating and upgrading said gas which then flows upwardly through the bed contributing to the process in the same manner as the hot process gas.

2. Apparatus according to claim 1 wherein said means for introducing said cold process gas comprises a bustle surrounding said furnace, a multiplicity of gas inlet pipes communicating with said bustle and the interior of said furnace, and a source of said cold process gas communicating with said bustle.

3. Apparatus according to claim 2 wherein said gas inlet pipes are inclined downwardly from said bustle.

4. Apparatus according to claim 1 further comprising a cooling zone beneath said means for introducing cold process gas to said packed bed and means for cooling said treated product in said cooling zone.

5. Apparatus according to claim 1 wherein said means for introducing said cold process gas comprises a source of cold process gas and a gas inlet communicating with said source and the interior of said furnace.

6. Apparatus according to claim 5 wherein said gas inlet is a slot.

7. Apparatus according to claim 6 wherein said slot is rectangular.

* * * * *